US010251485B2

(12) United States Patent
Sewell et al.

(10) Patent No.: US 10,251,485 B2
(45) Date of Patent: Apr. 9, 2019

(54) SEATING FURNITURE

(71) Applicant: Campaign Inc., Emeryville, CA (US)

(72) Inventors: Bradley Sewell, Emeryville, CA (US); Raul Molina, Emeryville, CA (US); Katherine Gossett, Oakland, CA (US)

(73) Assignee: Campaign, Inc., Emeryville, CA (US)

( * ) Notice: Subject to any disclaimer, the term of this patent is extended or adjusted under 35 U.S.C. 154(b) by 291 days.

(21) Appl. No.: 15/247,092

(22) Filed: Aug. 25, 2016

(65) Prior Publication Data

US 2017/0055710 A1 Mar. 2, 2017

Related U.S. Application Data

(60) Provisional application No. 62/209,648, filed on Aug. 25, 2015, provisional application No. 62/378,874, filed on Aug. 24, 2016.

(51) Int. Cl.
*A47C 4/02* (2006.01)

(52) U.S. Cl.
CPC ..... *A47C 4/028* (2013.01)

(58) Field of Classification Search
CPC ..... A47C 4/28; A47C 4/00; A47C 4/028
USPC ..... 297/440.23, 440.1; 29/428
See application file for complete search history.

(56) References Cited

U.S. PATENT DOCUMENTS

| | | | | | |
|---|---|---|---|---|---|
| 1,392,242 | A * | 9/1921 | Albergoli | F16B 12/48 | 297/440.1 |
| 3,030,146 | A | 4/1962 | Morris | | |
| 3,058,777 | A * | 10/1962 | Froedge | F16B 12/40 | 182/228.4 |
| 3,104,913 | A * | 9/1963 | Faulkner | A47C 4/02 | 297/218.3 |
| 3,887,234 | A * | 6/1975 | Curtis | A47C 5/12 | 297/440.23 |
| 4,043,591 | A * | 8/1977 | Lehmann | A47C 13/005 | 297/248 |
| 4,435,103 | A * | 3/1984 | Becker | A47B 13/02 | 403/292 |
| 5,306,072 | A * | 4/1994 | Caldwell | A47C 11/005 | 297/232 |
| 5,529,380 | A | 6/1996 | Blansett | | |
| 5,649,742 | A * | 7/1997 | Liu | A47C 3/00 | 297/440.22 |
| 5,678,897 | A | 10/1997 | Prestia | | |
| 5,988,755 | A * | 11/1999 | Fastelli | A47C 4/022 | 297/440.1 |
| 6,669,401 | B1 * | 12/2003 | Lin | A47C 11/00 | 297/440.1 |
| 6,783,182 | B1 | 8/2004 | Gallagher | | |
| 7,438,361 | B1 | 10/2008 | Huang | | |
| 8,356,954 | B2 | 1/2013 | Koch | | |
| 2004/0140706 | A1 | 7/2004 | Harrison | | |
| 2015/0305504 | A1 | 10/2015 | Robinson | | |

* cited by examiner

*Primary Examiner* — Milton Nelson, Jr.
(74) *Attorney, Agent, or Firm* — Bejin Bieneman PLC

(57) ABSTRACT

Disclosed herein is an easily to assemble seating furniture of the present disclosure includes a back assembly, side assemblies, a front assembly, legs, and a seating assembly. The legs are used to secure the back assembly and the front assembly to the side assemblies.

16 Claims, 10 Drawing Sheets

SEATING FURNITURE

CROSS-REFERENCE TO RELATED APPLICATIONS

The subject patent application claims priority to and all the benefits of U.S. Provisional Patent Application No. 62/209,648 filed on Aug. 25, 2015, which is herein incorporated by reference in its entirety. The subject patent application also claims priority to and all the benefits of U.S. Provisional Patent Application No. 62/378,874 filed on Aug. 24, 2016, which is herein incorporated by reference in its entirety

BACKGROUND

Various seating furniture structures such as chairs, loves seats and couches are generally known. Traditionally, this furniture is either preassembled or requires assembly by a user. Preassembled furniture can be bulky and expensive to ship and move from location to location. Furniture requiring assembly typically is not as robust, may be difficult and time consuming to assemble, and may not easily disassemble and reassemble for easy moving.

Accordingly, seating furniture that is easy to assembly, and is robust, is desired.

DETAILED DESCRIPTION

Figure 1:
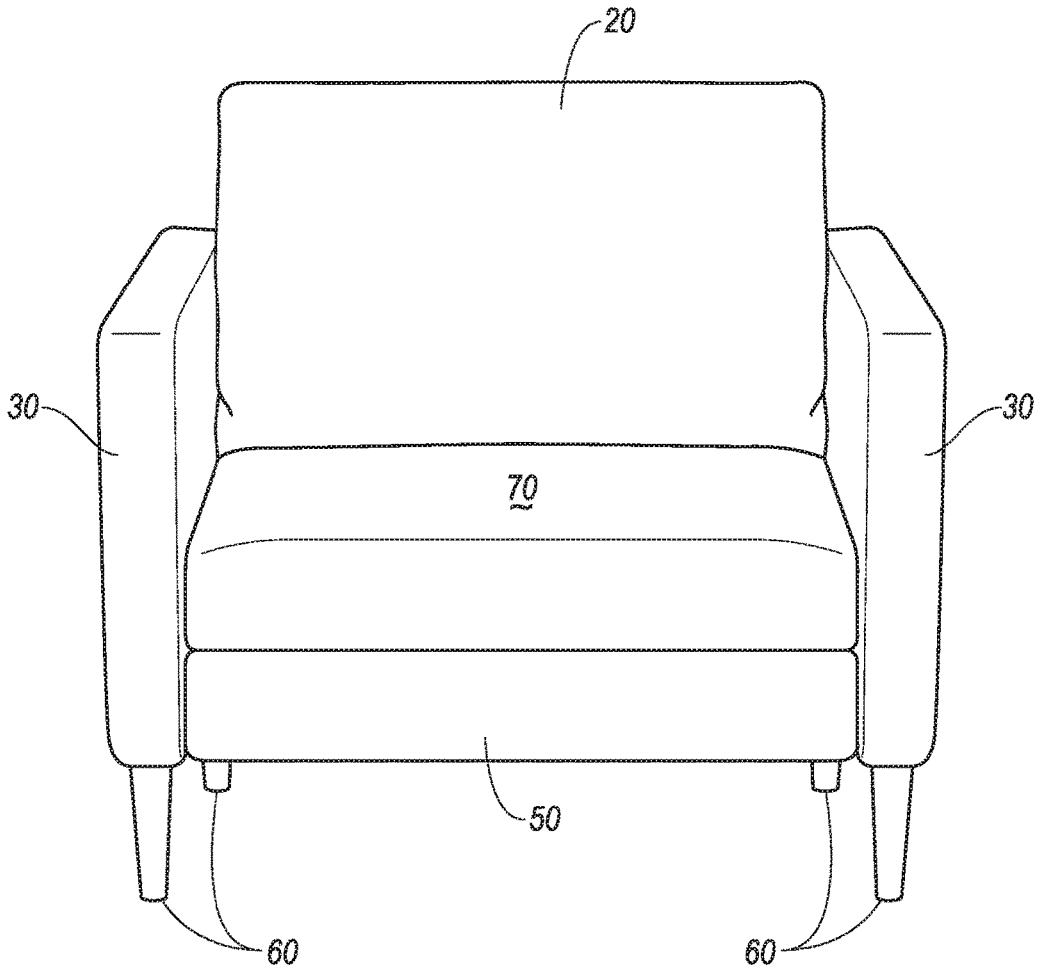
FIG. 1 is a perspective view of an easy to assembly piece of seating furniture.
Figure 2:
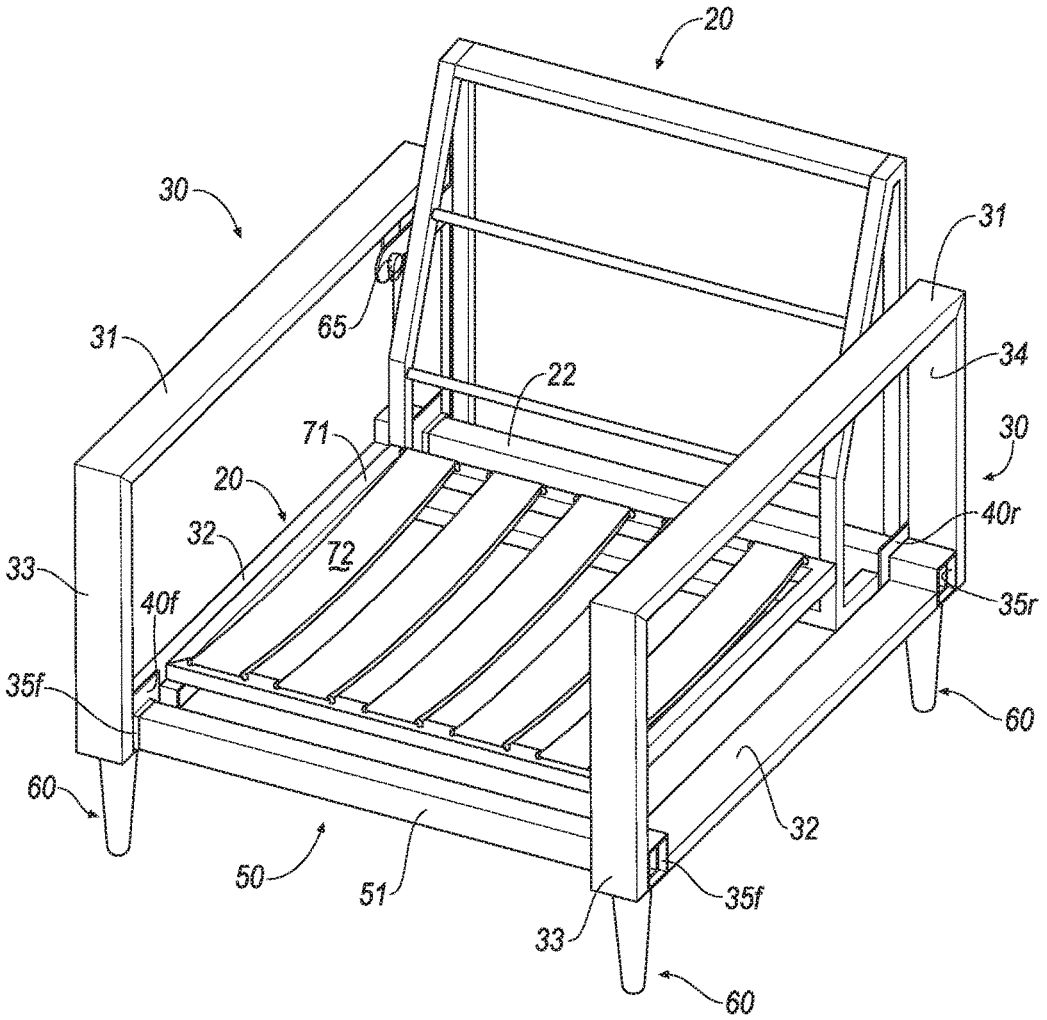
FIG. 2 is a perspective view of a frame of the easy to assemble piece of seating furniture.

With reference to the Figures, wherein like numerals indicate like parts throughout the several views, the relative directions such as front, rear, back, side, bottom, and top are based on the perspective of a user sitting in the seating furniture in a traditional manner.

As shown in FIGS. 1-10, the easily to assemble seating furniture of the present disclosure includes a back assembly 20, side assemblies 30, a front assembly 50, legs 60, and a seating assembly 70.

Figure 3:
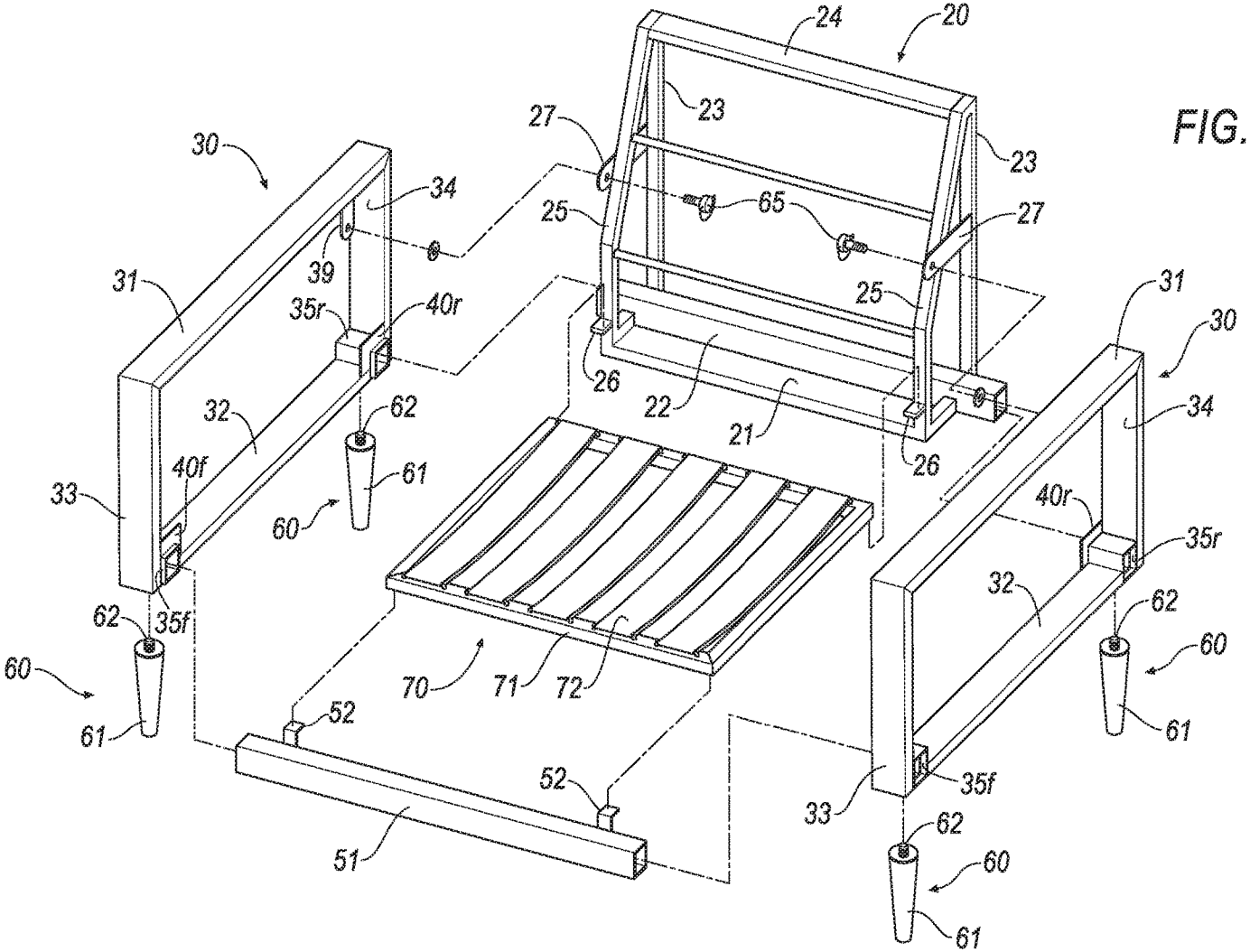
FIG. 3 is an exploded perspective view of assemblies forming the frame of the easy to assemble piece of seating furniture.
Figure 9:
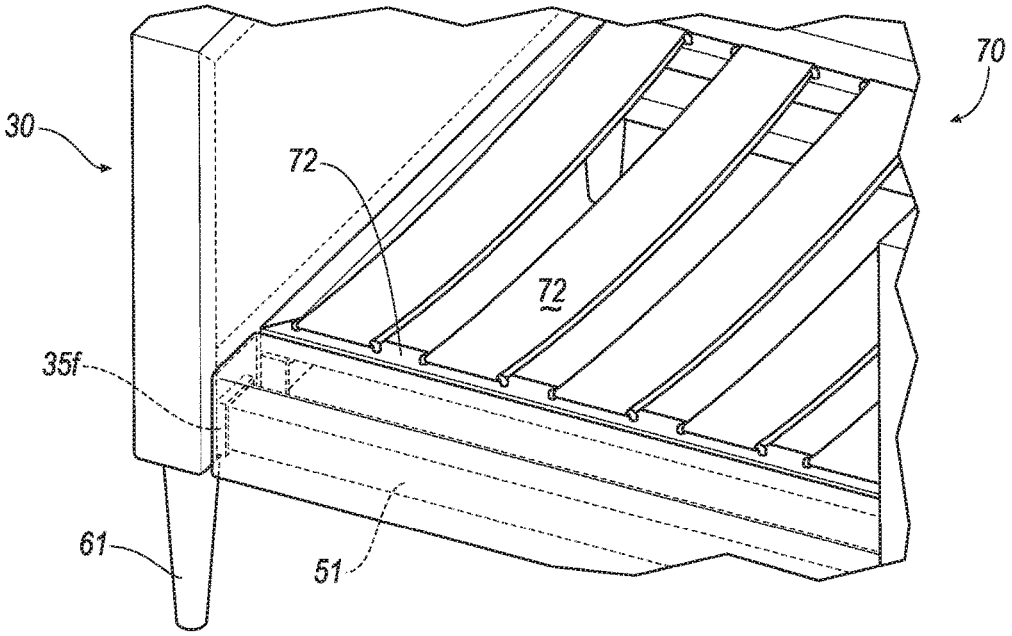
FIG. 9 is a close up perspective view of a portion of the easy to assemble piece of seating furniture.
Figure 10:
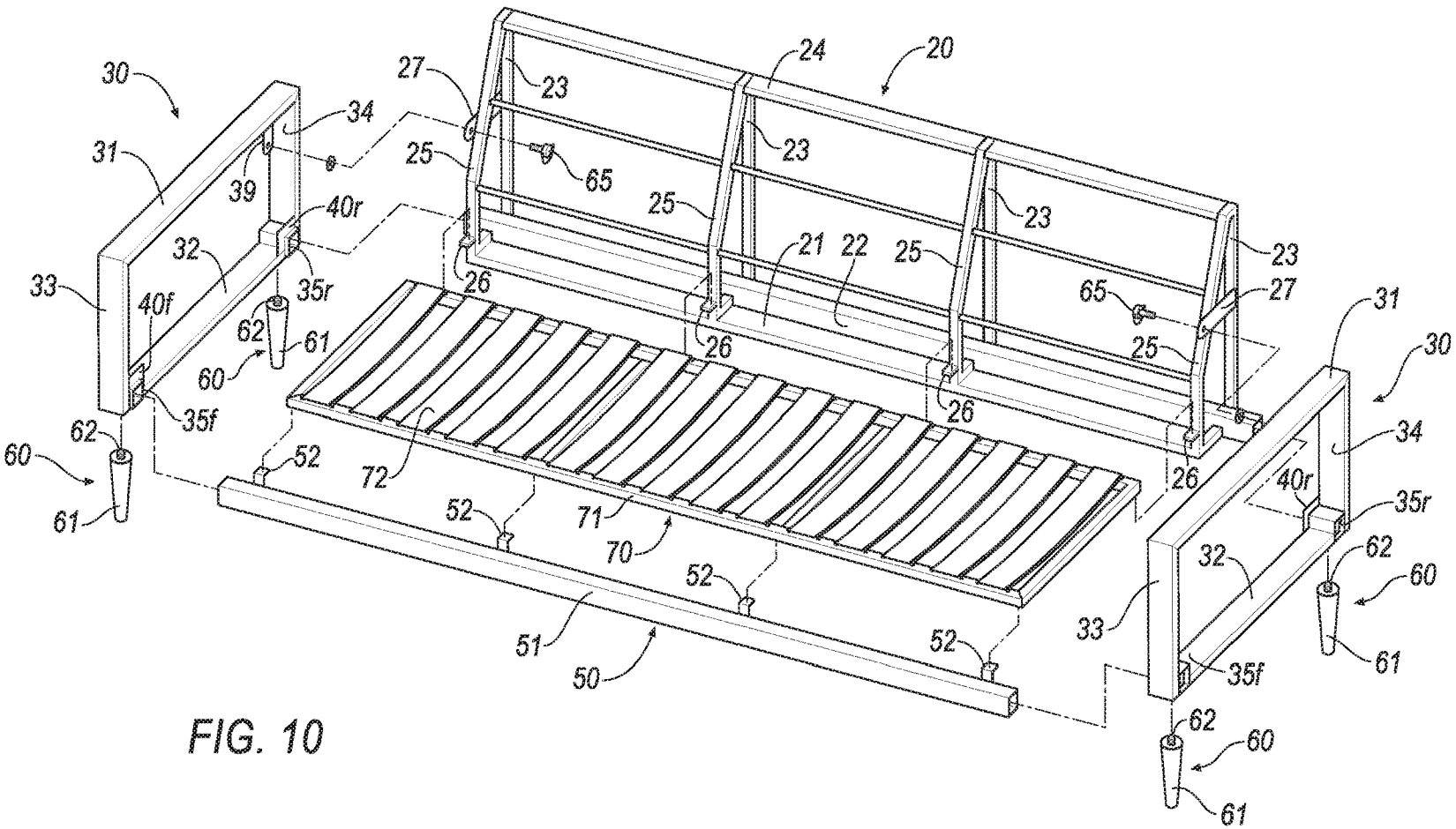
FIG. 10 is an exploded perspective view of assemblies forming a frame of an alternate easy to assemble piece of seating furniture.

With reference to FIGS. 3 and 9, the back assembly 20 includes a base plate 21, a rear member such as a rear beam 22, a first pair of support beams 23, a top beam 24, a second pair of support beams 25, a suspension frame supports 26 and a pair of side plates 27.

The base plate 21 is planar in form with a generally rectangular shape. The base plate has a top surface, a bottom surface, a front edge, a rear edge, and side edges.

The rear beam 22 is an elongated single piece member with a hollow square cross section. The rear beam 22 is secured to the top surface of the base plate 21, and runs parallel to the rear edge of the base plate 21. Opposing distal ends of the rear beam 22 extend beyond the side edges of the base plate 21. A hole is located in the rear beam 22 proximate each distal end. The interior surface of the hole may be threaded. The hole is supported by a reinforcement portion 28, for example a weld nut secured to the interior of the rear beam 22 about the hole such that the axis of the nut and the axis of the hole align.

The distal ends of the rear beam 22 are used use to secure the side assembly 30 to the back assembly 20. As such, the extension of the distal ends may be achieved by a multi-piece rear beam, with a distal end of each piece extending from opposing sides of the rear assembly and the multiple pieces of the rear beam connected by additional rear assembly frame components (not shown).

The first pair of support beams 23 are elongated members that extend generally normal from the base plate 21 at various locations along the rear edge. The support beams 23 are secured to the base plate 21 and the rear beam 22. The support beams 23 are further supported by a crossbar member extending there between. It is understood and appreciated that more than two support beams can be used based on various design criteria such as material properties, and seating furniture design. Additional support beams 23 can be used for width designs such as chairs, love seats, and couches. For example, compare the frames assemblies shown in FIGS. 3 and 9. The top support beam 24 runs generally parallel to the rear beam 22, and is secured to the tops of the support beams 23.

The second pair of support beams 25 are secured at various locations along the front edge of the base plate 21 and extend to the top beam 24, to which they are secured. The support beams 25 include first and second linear portions jointed at an obtuse angle. Similar to the support beams 23; additional support beams 25 can be used depending on material and design selection.

The frame supports 26 have an elongated L-shape with a pair of planar square surfaces joining at a generally perpendicular angle. One of the surfaces of each frame support 26 is secured to one of the support beams 25. The other surface of each frame member extends away from the support beams 25, being generally parallel to the base plate 21.

The pair of side plates 27 are planar in form, generally rectangular in shape, with a rounded, half circle end. Each side plate 27 is secured to one of the support beams 23 and to one of the support beams 25 such that the side plate extends from the support beam 23 across the support beam 25 with the rounded half circle end extend beyond the support beam 25. A hole is located in each side plate 27 at the rounded half circle end. The side plates 27 are aligned generally perpendicular to the base plate 21.

The side assembly 30 includes an upper beam 31, a lower beam 32, a front beam 33, a rear beam 34, front beam receiving portions 35*f*, rear beam receiving portions 35*r*, and a side plate 39. The upper beam 31, lower beam 32, front beam 33 and rear beam 34 are all secured to each other to provide the side assembly 30 with a generally rectangular shape. The front member receiving structure 35*f* and rear member receiving structure 35*r* located are at intersection of the lower beam 32 and the relative front beam 33 and rear beam 34 such that opposing distal ends of the lower beam 32 are secured to the member receiving structures 35*f* 35*r* with the member receiving structures 35*f* 35*r* secured to the relative front beam 33 and rear beam 34.

The member receiving structures 35*f* 35*r* have an elongate hollow rectangular shape defining a front opening 37*f* and a rear opening 37*r*, respectively. Holes are located in a bottom portion of the member receiving structures 35*f* 35*r*.

A front support plate 40*f* is secured to the front member receiving structure 35*f*, the front beam 33 and lower beam 32. A rear support plate 40*r* is secured to the rear member receiving structure 35*r*, the rear beam 34 and lower beam 32. The support plates 40*f* 40*r* have a planar L-shape. The receiving structures 35*f* 35*r* are secured to the edges of the support plates 40*f* 40*r* adjacent the inside cornet of the L-shape. The beams 32 33 34 are secured to the edges at the ends of the L-shape adjacent the edges secured to the receiving structures 35*f* 35*r*.

The side plate 39 is planar in form, generally rectangular in shape, with a rounded, half circle end. The side plate 39 extends downward from the upper beam 31. A hole is located in each side plate 39 at the rounded half circle end. The hole may be threaded, and/or may be supported by a reinforcement portion, for example a weld nut secured to the side plate 39 about the hole such that the axis of the nut and the axis of the hole align.

The front assembly 50 includes a front member, such as a front beam 51, and a pair of suspension frame supports 52.

The front beam 51 is an elongated member with a hollow square cross section. A hole is located in the front beam proximate each distal end. The interior surface of the hole may be threaded. The hole is supported by a reinforcement portion 28, for example a weld nut secured to the interior of the front beam 51 about the hole such that the axis of the nut and the axis of the hole align. The frame supports 52 have an elongated L-shape with a pair of planar square surfaces joining at a generally perpendicular angle. One of the surfaces of each frame support 52 is secured to one the front beam 51, spaced apart from each other. The other surface of each frame member extends away from the front beam 51.

The distal ends of the front beam 51 are used use to secure the side assembly 30 to the front assembly 50. As such, the extension of the distal ends may be achieved by a multi-piece front beam, with a distal end of each piece extending from opposing sides of the front assembly and the multiple pieces of the front beam connected by additional front assembly frame components (not shown).

The frame of the back assembly 20, side assemblies 30, and front assembly 50 are made from sheet steel and square steel tube steel cut to the appropriate shape, and secured together with welding.

The back assembly 20, side assemblies 30, and front assembly 50 may all be enclosed in fabrics, other coverings and padding, as is known to those skilled in the art. Such enclosure is configured to provide access to structural features necessary in the final assembly process, such as, but not limited to, the distal ends of the front beam 51 and rear beam 22, and the opening 37*f* 37*r*.

The legs 60 include a main body 61 and an attachment member 62. The main body has a frusto-conical shape. The attachment member 62 extends from main body 61 as a threaded shaft.

Each distal end of the rear beam 22 is received in the rear opening 37*r* in one of the side assemblies 30, and aligned such that the hole in the distal end aligns with the hole in the receiving portion 35*r*. The attachment member 62 is received in the hole in the distal end of the rear beam 22 and in the hole in the receiving portion 35*r*. The threaded shaft of attachment member 62 engages the weld nut of the reinforcement portion 35 to secure the leg 60, rear assembly 20 and side assembly 30 together.

Figure 6:
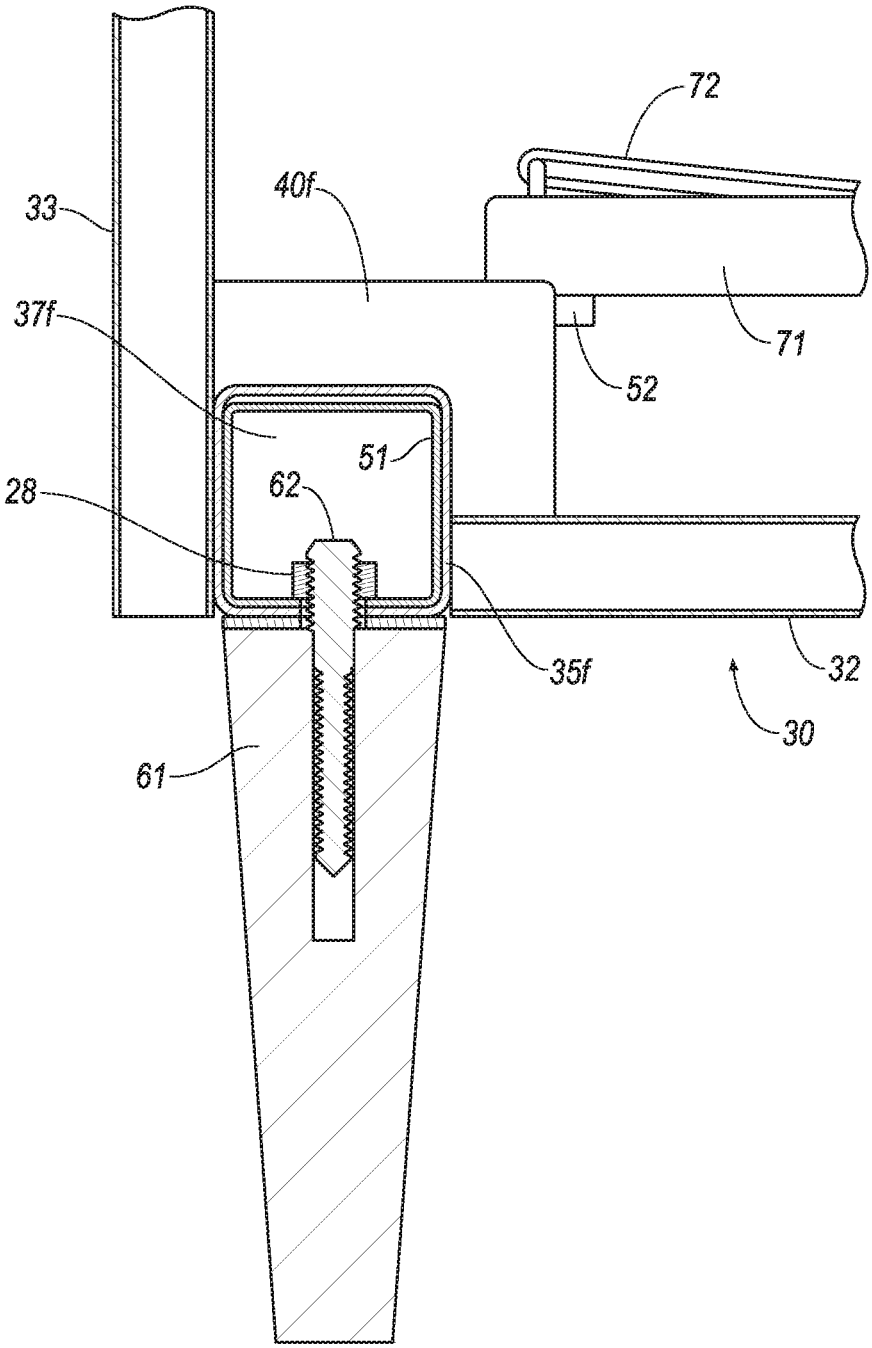
FIG. 6 is a close up side section view of a portion of the frame of the easy to assemble piece of seating furniture.
Figure 7:
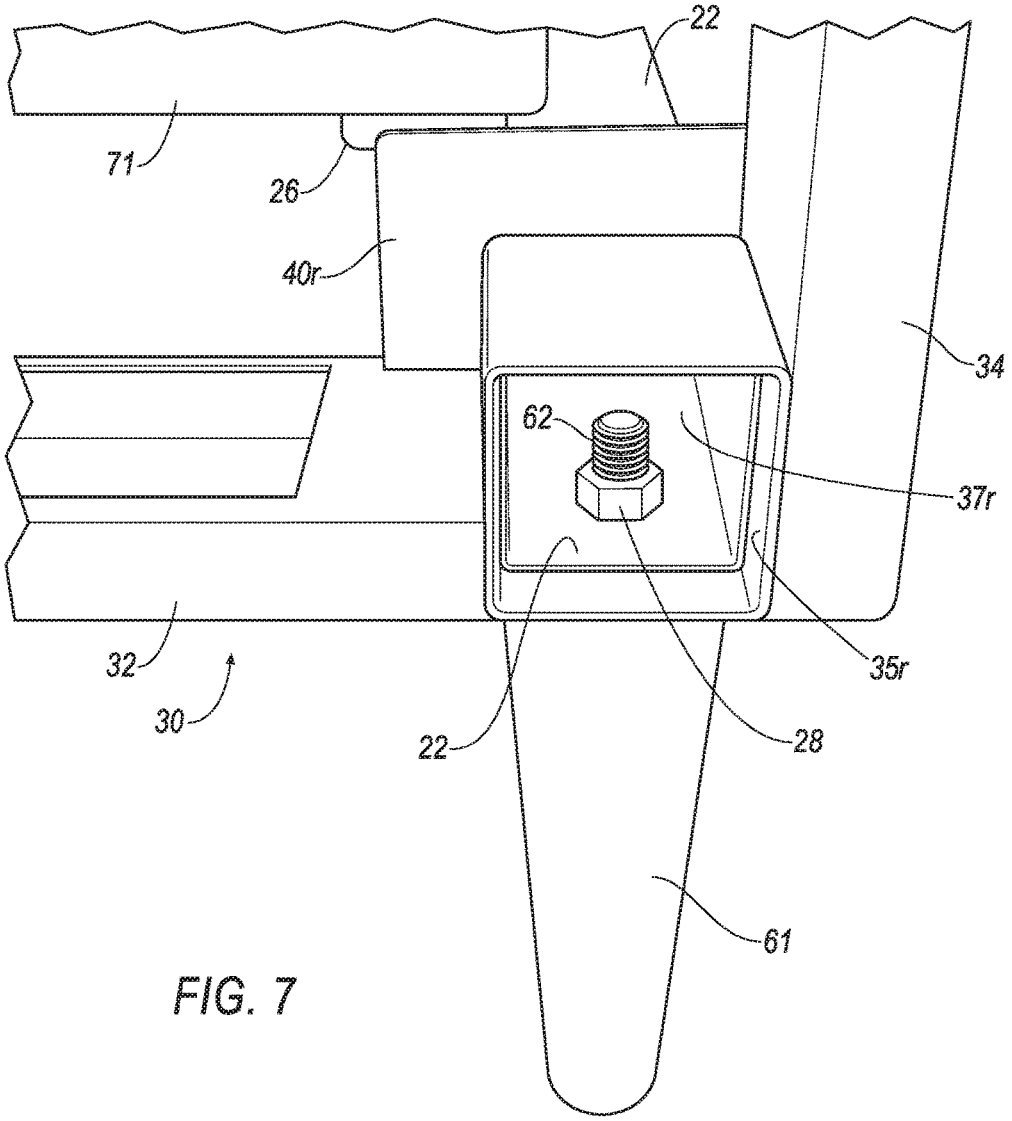
FIG. 7 is a close up perspective view of a portion of the frame of the easy to assemble piece of seating furniture.
Figure 8:
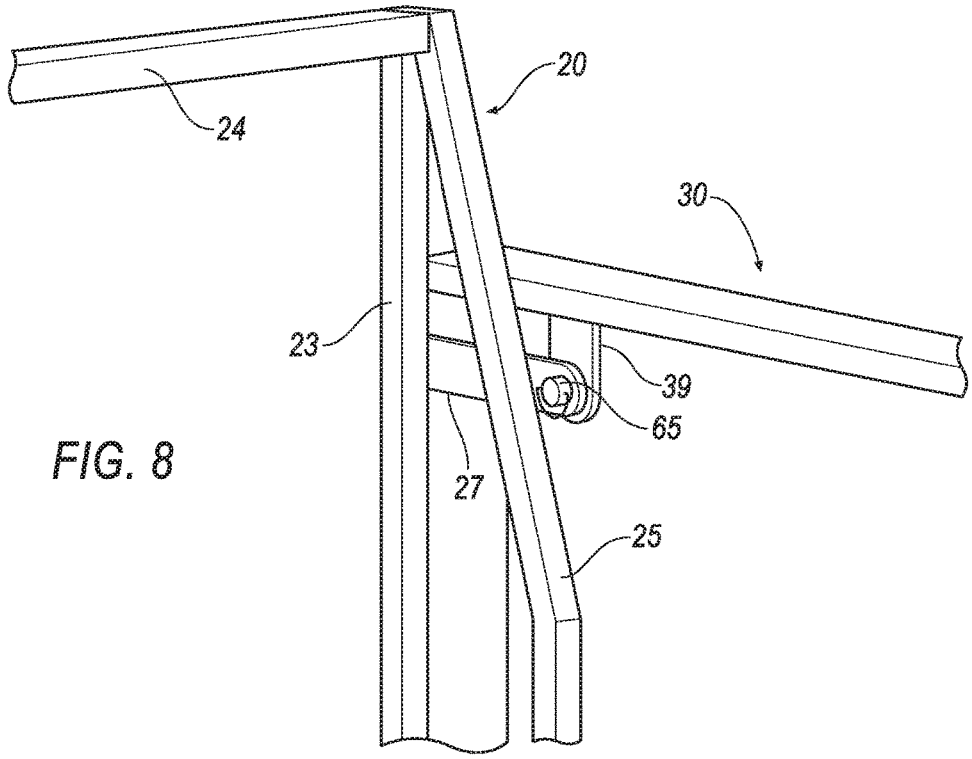
FIG. 8 is a close up perspective view of a portion of the frame of the easy to assemble piece of seating furniture.

Similarly, each distal end of the front beam 51 is received in the front opening 37*f* in one of the side assemblies 30, being aligned and secured with leg 60 as described above. A cross sectional of the front beam 51 received in the front opening is shown in FIG. 6, a cross section of the rear beam 22 in the rear opening 37*r* is substantially similar.

The front and rear receiving portions 35*f* 35*r* are configured to receive the ends of the respective front beam 51 and rear beam 22 by the openings 37*f* 37*r* having an inner perimeter that is complimentary to an outer perimeter of the distal end of the relative beam 22 51 such that the beam 22 51 is a slip fit into the relative portion 35*f* 35*r* without excessive rotation or translation.

The hole in the side plate 27 and the hole in side plate 39 are axially aligned. A fastener, such as a D-ring screw 65 is received in the hole in the side plate 27, and engages the threads in the hole in the side plate 39 to further secure the side assembly 30 to the back assembly 20.

The back assembly 20 and front assembly 50 may be configured with various widths to provide the desired seating type, for example a chair, love seat or sofa.

The seating assembly 70 includes a suspension frame 71 and seating supports 72. The suspension frame 71 is rectangular in form, and dimensioned to rest on the frame supports 26 52 fitting within the bounds of, and abut, the back assembly 20, side assemblies 30, and front assembly 50. The seating support 72 may be flexible straps secured to and spanning the suspension frame. One or more seating cushions are placed on seating assembly 70.

Figure 4:
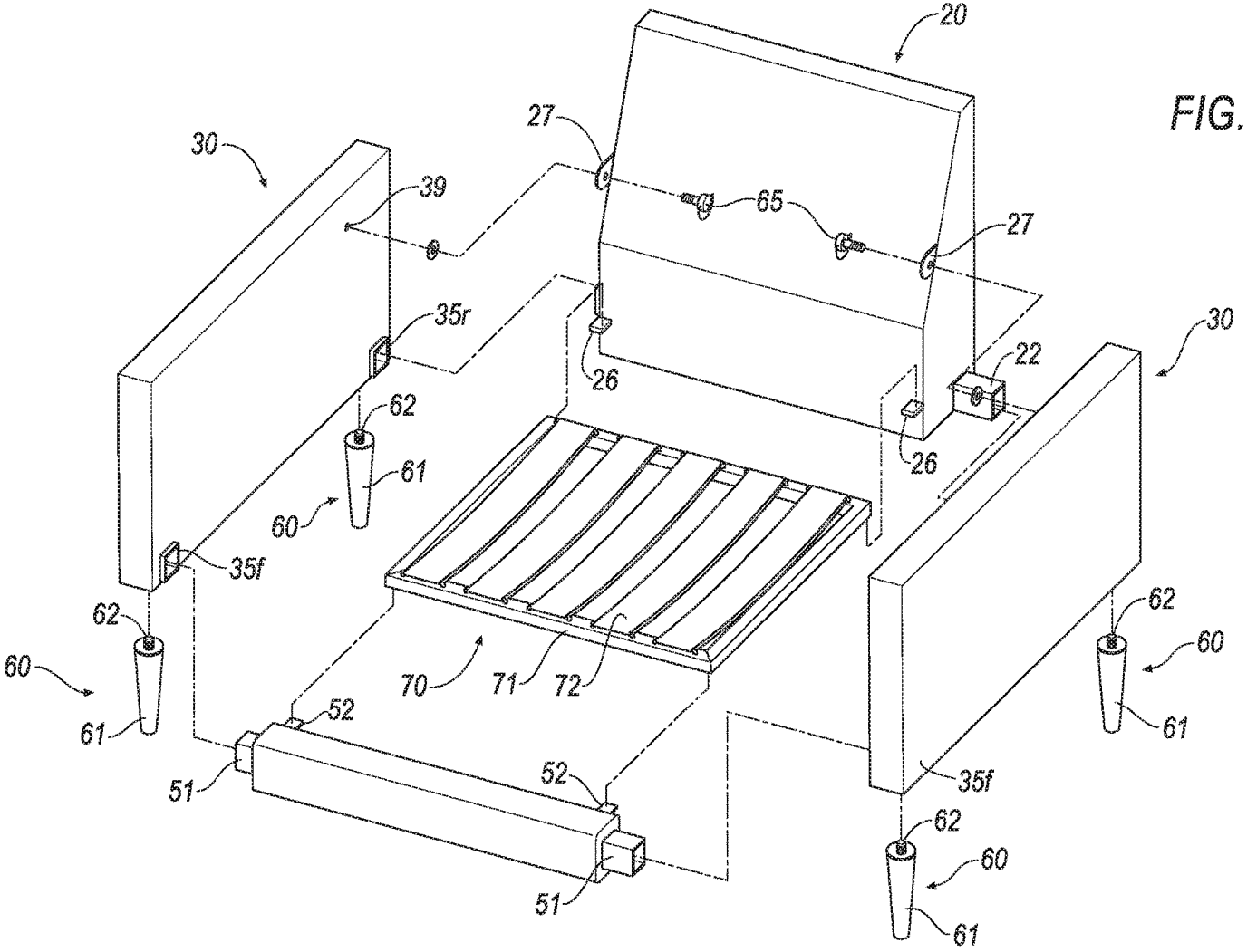
FIG. 4 is an exploded perspective view of assemblies in a kit used in forming the easy to assemble piece of seating furniture.
Figure 5:
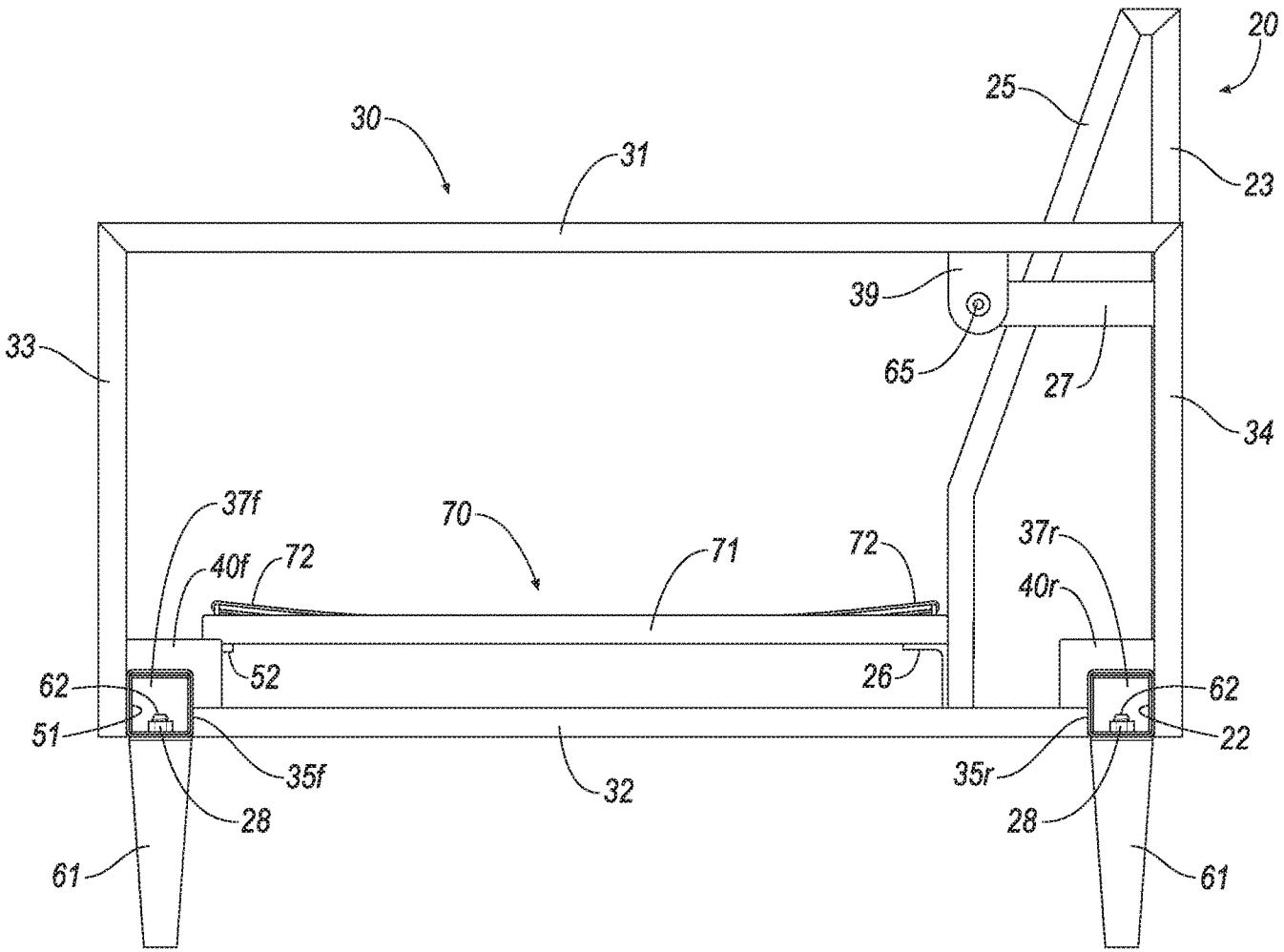
FIG. 5 is a side view of the frame of the easy to assemble piece of seating furniture.

With reference to FIG. 4, the easy to assemble piece of seating furniture may be provided as a kit a user for assemble. With the exception of pillows and other comfort items, the seat furniture can be made of the back assembly 20, side assemblies 30, front assembly 50, and seating portion 70. These components may be secured together using on the legs 60 and D-ring screws 65. Using only the steps detailed in the method below, the easy to assemble piece of seating furniture may be assembled without the use of any additional parts or tools.

Figure 11:
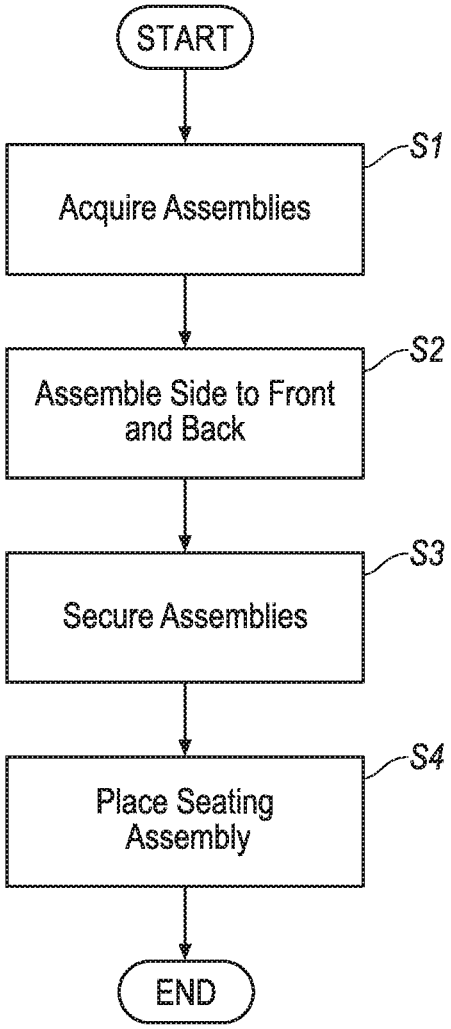
FIG. 11 is flow chart showing the step to assemble the kit used in forming the easy to assemble piece of seating furniture

With reference to FIG. 11, the method to assemble is as follows:

At step S1, the back assembly, side assemblies, front assembly, legs, and seating assembly are acquired. The front assembly and rear assembly include members with extending ends which are receivable by receiving portions with openings in the side assemblies. The side assembly and rear assembly each include a side plate.

At step S2, the distal ends extending from the back assembly from the front assembly are inserted into the opening in the receiving portions of the side assemblies.

At step S3, the side assembly is secured to the rear assembly and the front assembly. To provide such securement, holes in the rear assembly side plate are aligned with holes in the distal ends extending from the back assembly from the front assembly are aligned with holes in the receiving portion of the side assemblies. Legs are inserted and secured into the holes in the front assembly, rear assembly, and side assemblies.

At step S4, the seating assembly is placed on the frame supports.

The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A seating apparatus, the seating apparatus comprising:

a front assembly comprising a front member with opposing distal ends and a pair of holes formed in the front member, one hole located proximate each distal end;

a back assembly comprising a rear member with opposing distal ends and a pair of holes formed in the rear member, one hole located proximate each distal end;

a pair of side assemblies, each side assembly comprising, a front member receiving structure defining an opening, with a hole formed in the front member receiving structure, and a rear member receiving structure defining an opening, with a hole formed in the rear member receiving structure;

a plurality of legs, each leg comprising a main body and an attachment member extending from the main body;

the distal ends of the front member are received in the opening of front member receiving structures of the pair of side assemblies such that each hole formed in the front member aligns with the one of the holes formed in the front member receiving structures;

the distal ends of the rear member are received in the opening of rear member receiving structures of the pair of side assemblies such that each hole formed in the front member aligns with one of the holes formed in the front member receiving structures; and the front assembly and the back assembly secured to the pair of side assemblies with the plurality of legs, the attachment member of the legs received in the holes of the front member and holes of the front member receiving structures, and in the holes of the rear member and holes of the rear member receiving structures.

2. The seating apparatus of claim 1, wherein, the rear assembly further comprises a side plate;

the side assembly further comprises a side plate; and the side plate of the rear assembly is secured to the side plate of the side assembly.

3. The seating apparatus of claim 1, wherein the front assembly includes a support bracket having an elongated L-shape secured to the front member.

4. The seating apparatus of claim 3, further comprising a seating member disposed above, and supported by, the support bracket.

5. The seating apparatus of claim 1, wherein each side assembly further comprises, an upper beam, a lower beam, a front beam and a rear beam;

one end of the lower beam is secured to the front member receiving structure with an opposite end of the lower beam secured to the rear member receiving structure;

one end of the front beam is secure to the front beam receiving structure, an opposite end of the front beam is secured to one end of the upper beam, an opposite end of the upper beam is secured to the rear beam; and the rear beam is secured to rear member receiving structure and the lower beam.

6. The seating apparatus of claim 5, wherein each side assembly further comprises a support plate having a planar L-shape, with the support plate secured to the lower beam, the front beam, and the front beam receiving structure.

7. The seating apparatus of claim 5, wherein, the rear assembly further comprises a support beam secured to the rear beam, and a side plate secured to the support beam, the side plate having a hole;

the side assembly further comprises a side plate secured to the upper beam, the side plate having a hole; and the side plate of the rear assembly is secured to the side plate of the side assembly such that the hole of the side plate of the rear assembly aligns with the hole of the side plate of the side assembly such that a fastener is received in the hole of the side plate of the rear assembly and the hole of the side plate of the side assembly.

8. The seating apparatus of claim 1, wherein the rear member has a hollow elongated rectangular shape with a bottom portion, the pair of holes in the rear member located along the bottom portion.

9. The seating apparatus of claim 8, wherein the rear member receiving structure has a hollow elongated rectangular shape with a bottom portion, the hole in the rear member receiving structure is located along the bottom portion, and the opening defined by the rear member receiving structure has a rectangular shape complimentary to the rectangular shape of the rear member.

10. The seating apparatus of claim 8, wherein the front member has a hollow elongated rectangular shape with a bottom portion, the pair of holes in the front member located along the bottom portion.

11. The seating apparatus of claim 10, wherein the rear member further comprises a pair of weld nuts, each weld nut positioned such that it aligns with one of the holes, with the attachment member of one of the legs received by the weld nut.

12. The seating apparatus of claim 10, wherein the rear member receiving structure has a hollow elongated rectangular shape with a bottom portion, the hole in the rear member receiving structure is located along the bottom portion, and the opening defined by the rear member receiving structure has a rectangular shape complimentary to the rectangular shape of the rear member; and the front member receiving structure has a hollow elongated rectangular shape with a bottom portion, the hole in the front member receiving structure is located along the bottom portion, and the opening defined by the front member receiving structure has a rectangular shape complimentary to the rectangular shape of the front member.

13. A method of assembling a seating apparatus comprising the steps of:

acquiring, a front assembly comprising a front member with opposing distal ends and a pair of holes formed in the front member, one hole located proximate each distal end;

a back assembly comprising a rear member with opposing distal ends and a pair of holes formed in the rear member, one hole located proximate each distal end;

a pair of side assemblies, each side assembly comprising, a front member receiving structure defining an opening, with a hole formed in the front member receiving structure, and a rear member receiving structure defining an opening, with a hole formed in the rear member receiving structure;

a plurality of legs, each leg comprising a main body and an attachment member extending from the main body;

inserting the distal ends of the front member into the front member receiving structures of the pair of side assemblies such that the holes of the front member align with the holes of the front member receiving structures of the pair of side assemblies;

inserting the distal ends of the rear member into the rear member receiving structures of the pair of side assemblies such that the holes of the rear member align with the holes of the rear member receiving structures of the pair of side assemblies; and securing the front assembly and the back assembly to the pair of side assemblies by inserting the attachment members of the legs into the holes in the front assembly and the holes of the front member receiving structures of the pair of side assemblies, and into the holes in the rear member and the holes of the rear member receiving structures of the pair of side assemblies.

14. The method of claim 13, wherein the back assembly further comprises a side plate with a hole, and each of the side assemblies comprises a side plate with a hole, the method of assembling the seating apparatus further comprises the steps of, securing the side plates of the pair of side assemblies by aligning the holes and inserting a fastener.

15. A kit for assembling a seating apparatus, the kit comprising:

a front assembly comprising a front member with opposing distal ends and a pair of holes formed in the front member, one hole located proximate each distal end;

a back assembly comprising a rear member with opposing distal ends and a pair of holes formed in the rear member, one hole located proximate each distal end;

a pair of side assemblies, each side assembly comprising, a front member receiving structure defining an opening, with a hole formed in the front member receiving structure, and a rear member receiving structure defining an opening, with a hole formed in the rear member receiving structure;

a plurality of legs, each leg comprising a main body and an attachment member extending from the main body;

the distal ends of the front member are configured to be received in the opening of front member receiving structures of the pair of side assemblies such that each hole formed in the front member aligns with one of the holes formed in the front member receiving structures;

the distal ends of the rear member are configured to be received in the opening of rear member receiving structures of the pair of side assemblies such that each hole formed in the front member aligns with one of the holes formed in the front member receiving structures; and the front assembly and rear assembly are configured to be secured to the pair of side assemblies with the plurality of legs, the attachment member of the legs configured to be received in the holes of the front member and holes of the front member receiving structures, and in the holes of the rear member and holes of the rear member receiving structures.

16. The kit of claim 15, wherein, each side assembly further comprises, an upper beam, a lower beam, a front beam and a rear beam;

the lower beam is secured to the front member receiving structure and the rear member receiving structure;

the front beam is secured to the front member receiving structure and the upper beam;

the rear beam is secured to the rear member receiving structure and the lower beam;

the rear assembly further comprises a support beam secured to the rear beam, and a side plate secured to the support beam, the side plate having a hole;

the side assembly further comprises a side plate secured to the upper beam, the side plate having a hole; and the side plate of the rear assembly is configured to be secured to the side plate of the side assembly such that the hole of the side plate of the rear assembly aligns with the hole of the side plate of the side assembly with the hole of the side plate of the rear assembly and the hole of the side plate of the side assembly configured to receive a fastener.

* * * * *